US005339604A

United States Patent [19]

Aarts

[11] Patent Number: 5,339,604

[45] Date of Patent: Aug. 23, 1994

[54] METHOD AND APPARATUS FOR MAKING A VACUUM PACKAGE FILLED WITH GRANULAR MATERIAL

[75] Inventor: Mathias L. C. Aarts, Bilthoven, Netherlands

[73] Assignee: Sara Lee/DE N.V., Utrecht, Netherlands

[21] Appl. No.: 1,620

[22] Filed: Jan. 8, 1993

[30] Foreign Application Priority Data

Jan. 8, 1992 [NL] Netherlands ..... 9200022
Feb. 19, 1992 [NL] Netherlands ..... 9200314

[51] Int. Cl.[5] ..... B65B 31/00; B65B 61/26

[52] U.S. Cl. ..... 53/432; 53/131.2; 53/411; 53/453; 53/510

[58] Field of Search ..... 53/432, 433, 511, 510, 53/411, 131.2, 453, 559

[56] References Cited

U.S. PATENT DOCUMENTS 2,601,020 6/1952 Hopp .
4,684,025 8/1987 Copland et al. ..... 53/453 X
4,685,274 8/1987 Garwood ..... 53/433

FOREIGN PATENT DOCUMENTS 232931 8/1987 European Pat. Off. .
918159 2/1963 United Kingdom .

*Primary Examiner*—James F. Coan
*Attorney, Agent, or Firm*—Longacre & White

[57] ABSTRACT

A package made from a thin-walled and flexible packaging foil is filled with granular material and the filled package, placed in a holder with flat sidewalls, is vacuumized internally and closed. According to the invention, a relief element is mounted in a wall of a pair of oppositely disposed sidewalls of the holder. The relief element is pressed against the filled package supported by the sidewalls of the holder for the purpose of providing the package with a relief. The relief element depresses the filling locally without essentially changing the shape of the package. The formation of the relief occurs at a time when the pressure difference between the exterior and the interior of the package is less than the pressure difference prevailing when the closed vacuum package is arranged in an atmospheric environment. Thus, at that time, the filling is softer than the hardness of the filling when it is subject to the pressure difference mentioned last. The relief element remains pressed against the package, at least until the relief is fixed in the package by allowing the pressure difference between the interior and the exterior of the package to increase. Disclosed further is an apparatus for carrying out this method.

13 Claims, 1 Drawing Sheet

METHOD AND APPARATUS FOR MAKING A VACUUM PACKAGE FILLED WITH GRANULAR MATERIAL

Figure 1:
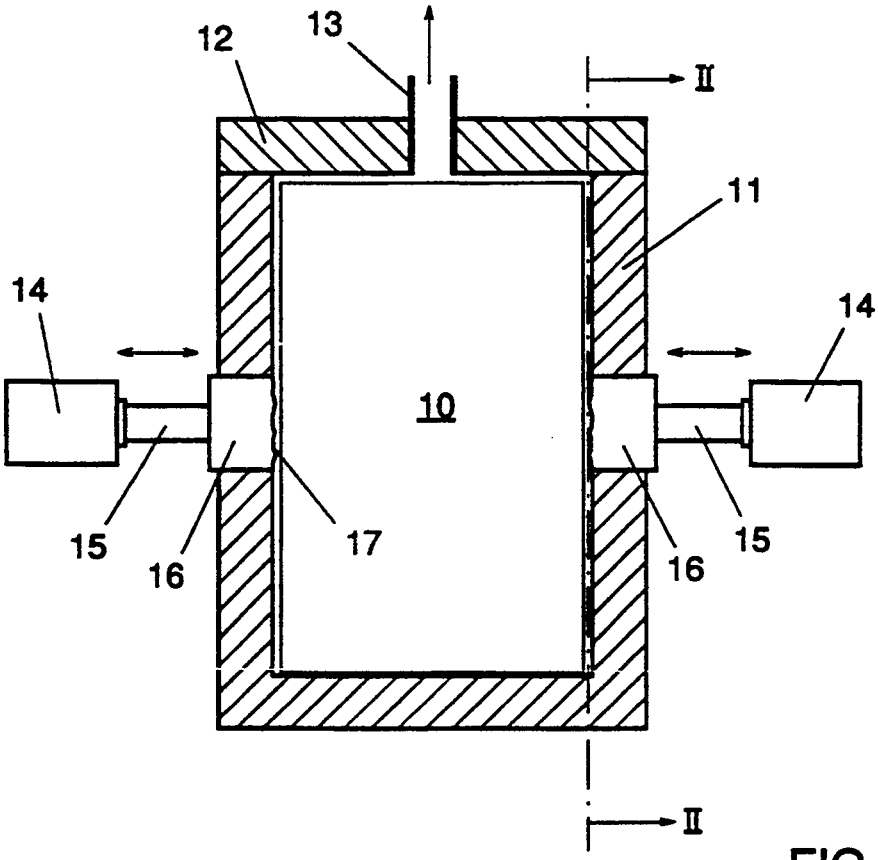

This invention relates to a method of making a vacuum package filled with granular material, in which a package made from a thin-walled and flexible packaging foil is filled with granular material, and the filled package, placed in a holder with flat sidewalls, is vacuumized internally and closed.

It may be desirable to provide such a package, which often has a rectangular cross-section, with a relief in one or more otherwise flat walls. The relief can for instance be provided in the package by striking a die or punch against the package when it has already been evacuated and closed. The relief must be struck with a relatively great force because the vacuum package becomes very hard and in fact forms a hard and rigid block, as a result of the great difference in pressure between the internal vacuum and the external atmospheric pressure, and as a result of the granular structure of the filling. A disadvantage associated with this is that the packaging foil may easily be damaged at the location of the relief during impression of the relief. The relief may thus be affected as well. Even worse, the foil may tear or be perforated, causing the vacuum in the package to be lost. Also, forming the relief in the hard package may cause the formation of undesired raised edges of different thicknesses around the impressions, which mar the appearance of the package and make it more difficult to arrange the packages in compact and mutually parallel configuration, for instance in a box, or to stack the packages in a stable manner.

The object of the invention is to provide a method of making a vacuum package, provide with a relief and filled with a granular material, in which the above-mentioned disadvantages are overcome.

To that end, the invention is characterized in that a relief element mounted in a wall of a pair of oppositely disposed sidewalls of the holder is pressed against the filled package supported by said sidewalls of the holder, so as to form a relief in the package, with the relief element depressing the filling locally without essentially changing the shape of the package, and the formation of the relief occurs at a time when the pressure difference between the exterior and the interior of the package is less than the pressure difference prevailing when the closed vacuum package is arranged in an atmospheric environment, so that at that time the filling is softer than the hardness of the filling when it is subject to the pressure difference mentioned last, and the relief element remains pressed against the package, at least until the relief is fixed in the package by allowing the pressure difference between the interior and the exterior of the package to increase.

The term "relief" is to be interpreted broadly. The relief may consist of figures, letters or other marks, giving information, for instance about the product packaged or the production process, or representing a trademark or brand. The relief can also serve to increase the visual appeal of the package. The relief can be designed as a so-called high relief, with the mark projecting externally, or a so-called bas-relief or low relief, with the mark forming a recessed depression in the package. The relief may also consist of line-shaped bulges on the package, having the same thickness throughout the length thereof, so as to enable the packages to be arranged against each other in parallel relationship but with a slight mutual clearance with respect to the flat sidewalls. The relief may also consist of both recessed and projecting portions of slight height or depth in the sidewalls of the package, provided in such a manner that two adjacent packages having their relieved walls facing each other can not only be arranged against each other but also be fitted into each other to some extent, whereby relative movement of the packages is prevented or limited.

In general, the relief will be provided locally in an otherwise flat wall of a package, but, of course, if so desired, the entire wall can be provided with a relief or several reliefs can be provided on one package.

One aspect of the invention is that the relief is formed at a time when the filling in the package is relatively soft and therefore easily deformable. This is achieved by pressing the relief element against the package at a time when the difference in pressure across the packaging foil of the package is, to a greater or lesser extent, less than in the case where the vacuum package is disposed in an atmospheric environment and has become rigid. Normally, the relief element is held against the package until the difference in pressure inside and outside the package is equal to the difference in pressure between the atmospheric external pressure exerted on the package and the vacuum within the package. If so desired, the relief element can also be retracted earlier, namely, as soon as, upon admission of atmospheric pressure to the space around the package, the pressure difference has increased sufficiently for the relief to be fixed, i.e., the relief remains present in unaffected condition when the closed package is subject to normal handling.

It is important that the package is supported by the sidewalls of the holder at the time when the relief is impressed therein. This is necessary to prevent the portions of the package that surround the relief from bulging or otherwise deforming undesirably under the influence of the relief being impressed on the package. By supporting the sidewalls of the package during the formation of the relief, the package retains its outer shape and damage to the packaging material is avoided.

The relief element can be movably mounted in the wall of the holder. To provide the package with the relief, the relief element is moved towards the package, relatively to the holder sidewall supporting the package, and pressed into the package. Optionally, the relief element can be mounted in the wall of the holder in such a manner that the depth of the impact of the relief element on the package can be set.

Preferably, the relief element is mounted in a wall of a pair of parallel, oppositely disposed and mutually movable sidewalls of the holder and the relief is impressed on the package by moving the movable sidewalls of the holder towards each other.

The method can be carried out in ways that are principally different.

According to a first method, the relief is pressed into the filling during the manufacture of the package, i.e., before the filling of the package has been adjusted to the desired final level of vacuum in the closed package. If the package is disposed entirely within a vacuum chamber during evacuation, any difference in pressure between the interior and the exterior of the package remains slight or is absent altogether during evacuation. After the relief element is pressed against the, still soft, package before or after closure of the package, atmospheric air is admitted to the space around the closed package, so that the filling hardens and the relief is fixed. Then the relief element can be retracted.

It is also possible to subject the filled package externally to atmospheric pressure during evacuation. At the beginning of the evacuation, the pressure within the package is also substantially atmospheric, but it gradually decreases as evacuation progresses. As a result, the difference in pressure across the package increases. Before, during or shortly after the beginning of the evacuation, the relief element is pressed against the package and not removed until the difference in pressure upon continued evacuation has become sufficiently large to fix the relief. This method can be conveniently combined with the method according to European patent application no. 91.202.253.0 for making a vacuum package with a flat surface (except for the relief to be provided therein in accordance with the present invention), wherein the package is manufactured in a holder with movable walls. A relief element can then be built into one or more of the movable walls or be adjustably installed therein.

According to another method, the relief is provided after the vacuum package has been manufactured, while it is disposed in an atmospheric environment, i.e., is rigid. In this method, the initially large difference in pressure across the wall of the package is reduced by subjecting the exterior of the package to a subatmospheric pressure as well, so that the hardness of the package is reduced. When the package has become sufficiently soft, the relief element is pressed against the package and remains pressed thereto until the external subatmospheric pressure has been removed completely or sufficiently to allow the filling to become rigid again. The external subatmospheric pressure can be equal, higher or lower than the internal vacuum pressure, the main criterion being that the difference in pressure across the package must be sufficiently reduced to allow the relief to be pressed into the filling without damage to the package. Preferably, this method is carried out using a relief element that is mounted in a wall of a pair of parallel, oppositely located sidewalls of a holder for the package, these sidewalls being movable relatively to each other, whilst the subatmospheric pressure mentioned is applied to the space between the package and the holder surrounding the package with slight clearance, this subatmospheric pressure being lower than the vacuum pressure in the package, so that the package expands in the space mentioned and any irregularities in the surface of the packaging foil are leveled, followed by moving the movable holder sidewalls mentioned towards each other, so that these sidewalls press the level foil against the filling of the package and the relief element mounted in the sidewall of the holder presses the relief into the package, and, in this condition, the subatmospheric pressure in the space referred to is removed, and the movable sidewalls with the relief element are retracted.

This last method can be advantageously combined with the method according to European patent application no. 92.200.782.0 for making a vacuum package with a smooth surface in a holder with movable walls.

The advantage of the present invention is that the thinwalled and flexible wall of the package is not damaged during the impression of the relief. In fact, the relief is pressed not so much into the packaging foil, which folds conformably to the relief in the filling, but into the filling, which deforms slightly as a result.

A relief according to the invention can be provided in a single side face of the package but also in two or more side faces simultaneously. The relief will generally have a slight depth, i.e., not more than is required for legibility or for recognition by touch by a blind person.

The package is completely filled with granular material during the provision of the relief. Before the package is evacuated, the filling can optionally be compacted to some extent by subjecting the package to a vibratory motion and/or by lightly ramming the filling into the package from above. At the top, the filling is disposed against the top surface of the package. There must not be any empty space above the filling, to which the granular material could migrate. The relief is accordingly obtained without any change in the general shape of the package.

The invention further comprises an apparatus for making a vacuum package filled with granular material, comprising a holder with flat sidewalls for placing therein a package made from a thin-walled and flexible packaging foil, a vacuum means for applying vacuum to the contents of the vacuum package filled with granular material, disposed in the holder, and closing means for closing the vacuumized package, characterized by a relief element mounted in a wall of a pair of parallel, oppositely arranged sidewalls of the holder, for forming a relief in the package, said relief element being designed to be pressed against the filled package supported by said sidewalls of the holder, so as to form a relief in the package in a manner whereby the relief element depresses the filling at that point without changing the outer form of the package and at a time when the pressure difference between the exterior and the interior of the package is less than the pressure difference prevailing when the closed vacuum package is placed in an atmospheric environment, so that at that time the filling is softer than the hardness of the filling when it is subject to the pressure mentioned last, said relief element being designed to remain pressed against the package, at least until the relief is fixed in the package by allowing the difference in pressure between the interior and the exterior of the package to increase.

The invention is eminently suitable for use in vacuum packages having a high internal vacuum, for instance in the manufacture of packages formed as rectangular blocks, filled with coffee beans, which may or may not be ground, having a level of vacuum of the order of 50 mbar.

Figure 2:
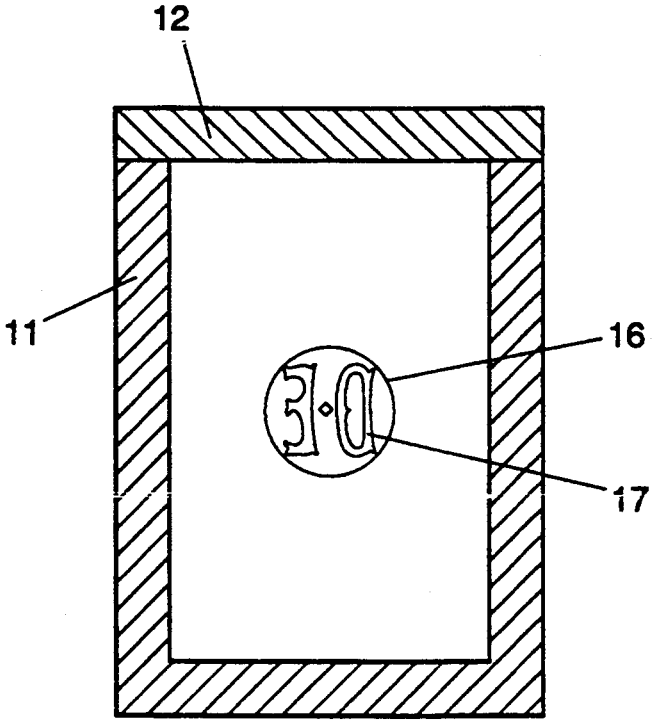

The invention will now be further explained, by way of example only, with reference to the accompanying schematic drawings in which:

FIG. 1 is a vertical section of an apparatus for carrying out the invention, and FIG. 2 is a vertical section taken on the line II—II of the apparatus shown in FIG. 1.

The drawings show a box-shaped, rectangular rigid holder 11, whose open top can be sealed airtightly with a cover 12. Mounted on the cover 12 is a length of pipe 13 communicating with the interior of the holder and adapted to be connected to a space connected with a vacuum pump. Arranged in the holder is a package 10 to be provided with a relief. The package 10 is completely filled with granular material, i.e., up to the top surface, and is made from a thin-walled and flexible packaging foil such as paper and/or aluminum foil. Mounted in each of two oppositely located walls of the holder is a relief element 16 provided with a relief 17 on the end face thereof. The relief element is of cylindrical configuration at the location of the wall of the holder and can be moved back and forth in horizontal direction within the wall. The relief element is mounted at one end of a rod 15 having its other end disposed in a pressure means 14. The pressure means is designed for moving the relief element back and forth and pressing the relief 17 against the package 10 pneumatically, mechanically, or in any other suitable manner.

For carrying out the method according to the present invention, the apparatus can be used in different ways.

According to a first method, the package, not yet evacuated nor hermetically sealed, is arranged in the open holder 11, which is subsequently closed airtightly with the cover 12. The length of pipe 13 is now connected to a source of vacuum, so that the package is evacuated internally. In this step, the package within the holder is also subjected externally to the same vacuum pressure. Since no difference or substantially no difference in pressure arises across the wall of the package, the contents of the package remain compressible. During evacuation, the relief elements 16 are pressed inwards against the package 10 by means of the pressure means 14, so that the relief 17 is pressed into the package. After the package has been evacuated to the desired level, the package is hermetically sealed from above in a known manner, for instance by means of thermal welding jaws. Then, via the length of pipe 13, atmospheric air is admitted to the space around the package in the holder. Owing to the resultant difference in pressure inside and outside the package, the relief is fixed in the package, which has now become rigid. When the relief is fixed, the two relief elements 16 are retracted again into the sidewalls of the holder. The cover 12 can now be removed and the vacuum package can be taken from the holder.

According to a variant of this method, instead of a package that is yet to be evacuated and closed, a package that is already completely evacuated and hermetically closed is arranged in the holder 11. After the package has been arranged in the holder and the holder has been closed with the cover, the length of pipe 13 is connected to a vacuum, preferably having at least the same level of vacuum as the package. As a result of the reduction or the complete removal of the difference in pressure across the wall of the package, the initially rigid package becomes soft. In the same manner as described above, the reliefs 17 are now pressed into the package, whereafter atmospheric pressure is admitted to the space around the package in the holder. After the reliefs in the package have been fixed, the relief elements can be retracted and the package can be removed from the holder.

It is also possible to arrange a package that is still open and yet to be evacuated in a holder and to evacuate the contents of the package in the holder without subjecting the package to a vacuum externally. When such a holder is used, the relief elements must be pressed against the package before the difference in pressure across the wall of the package has become so large during evacuation that the package has become rigid. Preferably, the relief elements are or have been pressed against the package at the beginning of the evacuation, and here, too, the relief elements remain pressed against the package until the relief has been fixed. If the holder is designed with sidewalls capable of being moved towards each other, the relief elements can be mounted fixedly or movably relatively to the sidewalls. European patent application no. 91.202.253.0 mentioned above, discloses a holder comprising movable sidewalls, in which a package is evacuated internally, while the exterior of the package need not be subjected to a vacuum. The present invention can also be applied advantageously with this holder.

I claim:

1. A method for making a vacuum package of a given shape filled with a granular material, said vacuum package being provided with a relief formed by an area with relatively raised and recessed formations, wherein the method comprises the steps of:

completely filling a package made from a thin-walled and flexible packaging foil with a granular material;

placing said filled package in a holder with sidewalls, and internally vacuumizing and closing said filled package;

pressing a relief element against said filled package, said holder supporting said relief element in at least one of said sidewalls and supporting portions of said filled package surrounding said relief element, thereby forming a relief in said filled package without changing the given shape of said filled package;

maintaining said relief element pressed against said filled package and increasing a first pressure difference between an exterior and an interior of said filled package; wherein, said step of pressing occurs when said first pressure difference is less than a second pressure difference between said interior of said closed package and atmospheric pressure.

2. The method for making a vacuum package as set forth in claim 1, wherein said relief element is movably supported with respect to said at least one of said sidewalls, and during said pressing step is moved relative to said sidewall toward said package.

3. The method for making a vacuum package as set forth in claim 1, wherein at least one of said sidewalls moves relative to said holder, and during said pressing step said sidewall is moved to press said relief against said filled package.

4. The method for making a vacuum package as set forth in claim 1, wherein said step of pressing occurs before a desired final level of vacuum is achieved in said filled package.

5. The method for making a vacuum package as set forth in claim 4, wherein said step of pressing occurs before a vacuum is applied to said filled package.

6. The method for making a vacuum package as set forth in claim 4, wherein said step of pressing occurs after a vacuum is applied to said filled package.

7. A method for making a vacuum package filled with a granular material, said vacuum package being provided with a relief formed by an area with relatively raised and recessed formations, wherein the method comprises the steps of:

filling a package made from a thin-walled and flexible packaging foil with a granular material;

placing said filled package in a holder with sidewalls;

vacuumizing and closing said filled package to form an evacuated, closed package, disposed in an atmospheric environment;

subjecting said evacuated, closed package to a subatmospheric pressure reducing hardness of said closed package;

pressing a relief element against said closed package so as to form a relief in said filled package, and increasing said subatmospheric pressure to said atmospheric environment.

8. The method for making a vacuum package as set forth in claim 7, wherein said subatmospheric pressure is at least equal to a vacuum pressure in said closed package.

9. The method for making a vacuum package as set forth in claim 7, further comprising:

applying said subatmospheric pressure to a space between said closed package and said holder, said subatmospheric pressure being lower than a vacuum pressure in said closed package, thereby expanding said closed package within said space to level irregularities in said packaging foil;

subsequently moving at least one of said sidewalls relative to said holder and pressing said relief element against said closed package; and thereafter increasing said subatmospheric pressure and retracting said at least one movable sidewall.

10. An apparatus for making a vacuum package filled with a granular material, said apparatus forming said vacuum package with a relief formed by an area with relatively raised and recessed formations, wherein the apparatus comprises:

a holder with sidewalls for receiving a package made from a thin-walled and flexible packaging foil, said package being completely filled with a granular material;

a vacuum means for applying a vacuum to said package;

closing means for closing said vacuumized package to form a closed package;

a relief element positioned on at least one of said holder sidewalls for forming said relief on said closed package, said relief element presses against said closed package when a first difference in pressure between an exterior and interior of said package is less than a second difference in pressure between said interior of said closed package and atmospheric pressure, and said relief element remains pressed against said closed package while said first difference in pressure is increased.

11. The apparatus according to claim 10, wherein at least one of said sidewalls is adapted to move relative to said holder.

12. The apparatus according to claim 10, wherein said relief element is adapted to impress informational marks on said package.

13. The apparatus according to claim 10, wherein said relief element is provide on two opposing sidewalls.

* * * * *